US007160437B2

(12) United States Patent
Brown et al.

(10) Patent No.: US 7,160,437 B2
(45) Date of Patent: Jan. 9, 2007

(54) METHOD FOR DETERMINING THE SOURCE OF FOULING IN THERMAL CONVERSION PROCESS UNITS

(75) Inventors: Leo D. Brown, Baton Rouge, LA (US); Peter S. Maa, Baton Rouge, LA (US); William N. Olmstead, Basking Ridge, NJ (US); Michael Siskin, Randolph, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 440 days.

(21) Appl. No.: 10/680,920

(22) Filed: Oct. 8, 2003

(65) Prior Publication Data

US 2005/0040076 A1 Feb. 24, 2005

Related U.S. Application Data

(60) Provisional application No. 60/431,061, filed on Dec. 4, 2002.

(51) Int. Cl.
*C10B 55/10* (2006.01)
*C10G 9/32* (2006.01)

(52) U.S. Cl. ..... 208/127; 208/48 R; 208/125; 208/131; 208/132; 436/56; 436/139; 585/950

(58) Field of Classification Search ..... 436/56, 436/139; 208/48 R, 125, 132, 127, 131; 585/950
See application file for complete search history.

(56) References Cited

U.S. PATENT DOCUMENTS

| | | | | |
|---|---|---|---|---|
| 3,546,316 | A | 12/1970 | Koszman | 260/680 |
| 4,169,041 | A | 9/1979 | Schuette | 208/108 |
| 4,507,196 | A | 3/1985 | Reed et al. | 208/48 AA |
| 4,642,175 | A | 2/1987 | Rudnick | 208/88 |
| 4,756,819 | A | 7/1988 | Bousquet et al. | 208/48 AA |
| 4,770,764 | A | 9/1988 | Ohtake et al. | 208/73 |
| 4,863,892 | A | 9/1989 | Porter et al. | 502/170 |
| 5,000,836 | A | 3/1991 | Forester | 208/48 AA |
| 5,296,130 | A | 3/1994 | Kriz et al. | 208/107 |
| 5,658,455 | A | 8/1997 | Hammond et al. | 208/127 |
| 5,863,418 | A | 1/1999 | Heyse et al. | 208/135 |
| 5,919,352 | A | 7/1999 | Serrand et al. | 208/91 |

FOREIGN PATENT DOCUMENTS

WO WO98/58040 12/1998

OTHER PUBLICATIONS

Knapper et al., "Measurement of Efficiency of Distribution of Liquid Feed in a Gas-Solid Fluidized Bed Reactor", International Journal of Chemical Reactor Engineering, vol. 1, 2003 (abstract only).*

Kopinke, F.D., et al., "On the Mechanism of Coke Formation in Steam Cracking—Conclusions from Results Obtained by Tracer Experiments," *Carbon*, vol. 26, No. 2, pp. 117-124, 1988, XP-002274238.

Gentzis, T., et al., "A microscopic approach to determine the origin and mechanism of coke formation in fractionation towers," *Guildford*, GB, vol. 82, No. 12, Mar. 20, 2003, pp. 1531-1540, XP004423181, ISSN: 0016-2361.

* cited by examiner

*Primary Examiner*—Glenn Caldarola
*Assistant Examiner*—Prem C. Singh
(74) *Attorney, Agent, or Firm*—Jeremy J. Kliebert; Henry E. Naylor

(57) ABSTRACT

The present invention relates to a method for determining the source of fouling in petroleum thermal conversion process units. More particularly, the invention distinguishes whether fouling occurs due to feed entrainment of small feed droplets or vapor phase condensation.

21 Claims, No Drawings

METHOD FOR DETERMINING THE SOURCE OF FOULING IN THERMAL CONVERSION PROCESS UNITS

CROSS-REFERENCE TO RELATED APPLICATION

This application claims benefit of U.S. provisional patent application Ser. No. 60/431,061 filed Dec. 4, 2002.

FIELD OF THE INVENTION

The present invention relates to a method for determining the source of fouling in petroleum thermal conversion process units. More particularly, the invention distinguishes whether fouling occurs due to feed entrainment of small feed droplets or vapor phase condensation.

BACKGROUND OF THE INVENTION

Thermal conversion processes, such as coking, are commonly used in petroleum refineries for converting heavy hydrocarbon feedstocks to more valuable lower boiling products. Examples of two types of coking effective for this invention are short vapor contact time coking and fluidized bed coking. Short vapor contact time coking contains a short vapor contact time reaction zone containing a horizontal moving bed of fluidized hot solids recycled from a heating zone. The reaction zone is operated at a temperature from about 450° C. to about 700° C. (842–1292° F.) and under conditions such that the solids residence time and the vapor residence time are independently controlled. Conventional fluidized bed coking process units typically include a coking zone, a stripping zone, a coke regeneration zone and overhead equipment. A heavy carbonaceous petroleum feedstock is introduced into the coking zone containing a fluidized bed of hot solids, preferably coke. The feedstock is distributed as uniformly as possible over the surfaces of said coke particles where it is cracked to vapors and carbonaceous material that is deposited onto the hot solids. The vapors pass through cyclones that remove entrained coke particles. The vapor is then discharged into a scrubbing zone where any remaining solid particles are removed, the heaviest product is condensed and the vapor is then cooled to condensed products, which go to the fractionator. A slurry of heavy liquid and solid particles, which usually contains from about 1 to about 3 wt. % coke particles, is recycled to extinction from the scrubber to the coking zone.

During the coking process, the feedstocks that are thermally cracked have a tendency to form carbonaceous, insoluble solid deposits that coat and plug process equipment. The deposition of these deposits on process equipment is called fouling and the deposits are called the foulant. Coke plugs lines and damages overhead equipment such as cyclones. Even small amounts of coke deposited on the surface of process equipment can greatly reduce the efficiency of the equipment by reducing heat transfer. Large amounts of coke deposited on the surface of process equipment, e.g. cyclone snouts, can result in high-pressure drop which reduces throughput such that the unit has to be shut down to remove the coke deposits. Fouling may be due to a variety of causes, including feedstock entrainment and condensation of vaporized feedstock on surfaces that subsequently undergo thermal conversion to coke. Unfortunately, when such fouling occurred, one could not differentiate whether the source of the fouling was due to feedstock entrainment of small feed droplets or condensation of vaporized feedstocks. Therefore, there is a need in the art for a method for determining the source of such fouling so that the process conditions or the overhead equipment can be adjusted to reduce and/or mitigate coking.

SUMMARY OF THE INVENTION

In accordance with the present invention there is provided a method for determining the source of coke deposits in overhead equipment in a heavy hydrocarbon thermal conversion process unit for converting heavy hydrocarbon feedstock to lower boiling products, comprising the steps of:

- introducing an effective amount of at least one nonvolatile metal-containing organic compound into a heavy hydrocarbon feedstock, which said nonvolatile metal-containing organic compound is completely soluble in said heavy hydrocarbon feedstock;
- converting at least a fraction of said heavy hydrocarbon feedstock containing said nonvolatile metal-containing organic compound in a thermal conversion zone of said process unit to lower boiling products and resulting in a vapor product stream;
- passing said vapor product stream through at least one piece of overhead equipment associated with said thermal conversion process unit wherein coke deposits form in at least one piece of said overhead equipment;
- analyzing said coke deposits for the metal of said nonvolatile metal-containing compound; and
- determining that the source of coke deposits in said at least one piece of overhead equipment results from: (i) condensation of said vapor product stream or (ii) entrainment of feed droplets in said vapor product stream.

In a preferred embodiment, the nonvolatile metal-containing organic compound is selected from the group consisting of metalloporphyrins, metal acetylocetonates, and metal naphthenates.

In another preferred embodiment of the present invention the metal-containing organic compound is copper naphthenate.

DETAILED DESCRIPTION OF THE INVENTION

The present invention is suitable for use in any heavy hydrocarbon thermal conversion process unit where coke deposition of overhead equipment is a problem. Preferred heavy hydrocarbon thermal conversion processes include coking processes. Coking is generally carried out at relatively high temperatures at which the coking tendencies of the feedstocks become manifest, e.g. at temperatures above about 350° C. (about 662° F.) and more commonly above about 450° C. (about 840° F.).

Suitable heavy hydrocarbon feedstocks for use in the present invention include vacuum resids, atmospheric resids, heavy and reduced petroleum crude oil, pitch, asphalt, bitumen, coal slurries, coal liquefaction bottoms, the heaviest fractions of tar sand oil and shale oil, and mixtures thereof. Such feeds will typically have a Conradson carbon content of at least 5 wt. %, generally from about 5 to 50 wt. %. As to Conradson carbon residue, see ASTM Test D189-165.

A typical heavy hydrocarbon feedstock suitable for the practice of the present invention will typically have the composition and properties within the ranges set forth below.

| | |
|---|---|
| Conradson Carbon | 5 to 40 wt. % |
| Sulfur | 0.75 to 8 wt. % |
| Hydrogen | 9 to 12 wt. % |
| Nitrogen | 0.2 to 2 wt. % |
| Carbon | 80 to 88 wt. % |
| Metals | 1 to 2000 wppm |
| Boiling Point | 340° C. (644° F.) to 650 C.° (1202° F.) |
| Specific Gravity | −10 to 35° API |

This invention uses a hydrocarbon soluble, metal-containing compound that is substantially nonvolatile at the temperature of the thermal conversion process unit in which it is used as a tracer to distinguish the source of fouling in reactor overhead areas. The compound will preferably be about 95% nonvolatile, more preferably about 98% nonvolatile. Additionally, the compound will preferably be about at least 90% soluble in said feedstock, more preferably about at least 95% soluble in said feedstock and most preferably at least 99% soluble in said feedstock. All percents are by weight. The metal of the metal-containing compound will preferably be chosen to be different from metals that are typically inherent in the feed. Non-limiting examples of preferred metal-containing compounds suitable for use herein include metalloporphyrins, metal acetyloc-etonates, metal naphthenates and the like, more preferred is copper naphthenate. Volatility of the metal portion of the compound selected is a critical variable. For example, a Thermogravimetric Analysis (TGA) of copper naphthenate shows that at about 600° C. (1112° F.) a residue of 11.23 wt. % remains. The theoretical calculated residue for copper oxide, the thermal decomposition product of copper naphthenate is 11.34 wt. %. On the other hand, cobalt naphthenate leaves a residue of cobalt oxide of 6.45 wt. % versus the theoretical value of 10.6 wt. % for cobalt oxide, indicating that volatile cobalt material has evolved from this material. Thus, cobalt naphthanate would not be an acceptable tracer.

Non-limiting types of coking for which the present invention can be used include short vapor contact time coking and fluidized bed coking. A fluidized bed coking unit can be any conventional fluidized bed coking process unit which usually comprises a coking zone, a stripping zone, a coke regeneration zone and overhead equipment.

In broad terms, the operation of the fluidized bed coking unit proceeds as follows in the present invention: a heavy hydrocarbonaceous feedstock is doped with an effective amount of a substantially nonvolatile, hydrocarbon soluble, metal-containing compound, preferably copper naphthenate. By effective amount we mean the minimum amount of metal-containing compound that will result in a measurable amount of metal from the compound in the deposits resulting from the thermal conversion process. Such an amount will typically range from about 10 wppm to about 1000 wppm, preferably from about 25 wppm to about 500 wppm, and more preferably from about 50 wppm to about 200 wppm of said compound. The doped feedstock is then passed to the thermal conversion zone of a thermal conversion process unit, which is preferably a coking zone that contains a fluidized bed of solids, or so-called "seed" particles, which are typically coke particles. A fluidizing gas e.g. steam, is admitted at the base of coking zone in an amount sufficient to obtain superficial fluidizing velocity. Such a velocity is typically in the range of about 0.5 to 5 ft/sec. Coke, from a heating regeneration zone, at a temperature above the coking temperature, for example, a temperature from about 40° C. to 200° C., preferably from about 65° C. to 120° C. in excess of the actual operating temperature of the coking zone is admitted in an amount sufficient to maintain the coking temperature in the range of about 450° C. to 600° C. The pressure in the coking zone is maintained in the range of about 0 to 150 psig, preferably in the range of about 5 to 45 psig. The lower portion of the coking zone serves as a stripping zone to remove occluded hydrocarbons from the coke. A stream of stripped coke is withdrawn from the stripping zone and circulated to a heating zone. In the heating zone, the stripped coke is introduced to a fluid bed of hot coke particles wherein coke deposits are burned from the coke particles. The bed is heated by passing a fuel gas into the heating zone along with the coke particles. The gaseous effluent from the heating zone, including entrained solids, passes through one or more cyclones, wherein the separation of the larger entrained solids occur. The separated larger solids are returned to the heating zone. The gaseous effluent from the cyclones is removed from the process unit. Conversion products from the coking zone are passed through a cyclone to remove entrained solids that are returned to the coking zone through a dipleg. The vapors leave the cyclone and pass into a scrubbing zone. The scrubbed out stream of heavy materials and solids are recycled to the coking zone. The scrubbed coker conversion products are removed from the scrubbing zone for fractionation in a conventional manner.

While the above invention has been described in connection with a fluid coking process, it may also be practiced in short vapor contact time coking. In short vapor contact coking, the feedstock in the present invention is doped with the nonvolatile, hydrocarbon soluble, metal-containing compound, preferably copper naphthenate as previously described. This doped feedstock is then fed to a short vapor contact time reactor, which contains a horizontal moving bed of fluidized hot particles, which are received from a heating zone. The particles can be fluidized by any suitable means such as by use of fluidized gas, preferably steam, a mechanical means, and by use of vapors which result from the vaporization or cracking of a fraction of the feedstock. It is preferred that a mechanical means be used and that the mechanical means be a mechanical mixing system characterized as having a relatively high mixing efficiency with only minor amounts of axial backmixing. Such a mixing system acts like a plug flow system with a flow pattern that ensures that the residence time is nearly equal for all particles. The most preferred mechanical mixing system is the type disclosed in U.S. Pat. No. 5,919,352, which is incorporated by reference. Such a mixing system is comprised of a plurality of horizontally oriented rotating screws that aid in fluidizing the particles. Although it is preferred that the solid particles be coke particles, they may be any other suitable refractory material. Non-limiting examples of such other suitable refractory materials include those selected from the group consisting of silica, alumina, zirconia, magnesia, or mullite, synthetically prepared or naturally occurring material such as pumice, clay, kieselguhr, diatomaceous earth, bauxite, and the like. The solids will have an average particle size of about 40 to 1000 microns, preferably from about 500 to 800 microns.

When the doped feedstock is contacted with the hot solids, which will preferably be at a temperature from about 450° C. to about 700° C., more preferably from about 500° C. to 600° C., a major portion of the feedstock will be cracked and vaporized. The residence time of vapor in the short contact time thermal zone will be an effective amount of time so that substantial secondary cracking does not occur. This amount of time will typically be less than about 5 seconds, preferably less than about 4 seconds, more preferably less than about 3 seconds. That portion of the feed that does not immediately vaporize on contact with the hot solids will form a thin film on the hot solids where cracking reactions occur. This results in the formation of additional vapor products and a minor amount of carbonaceous material depositing on the hot solids. The residence time of solids in the short vapor contact time reactor will be from about 5 to 60 seconds, preferably from about 10 to 30 seconds. It is preferred that the short vapor contact time reactor be operated so that the ratio of solids to feed be from about 20 to 1, preferably from about 10 to 1. It is to be understood that the precise ratio of solids to feed will primarily depend on the heat balance requirement of the short contact time reactor. Associating the oil to solids ratio with heat balance requirements is within the skill of those having ordinary skill in the art, and thus will not be elaborated herein any further. A minor amount of the feedstock will deposit on the particles in the form of combustible carbonaceous material. Metal components will also deposit on the particles. Consequently, the vaporized portion that exits the process unit will be substantially lower in both Conradson Carbon and metals when compared to the original feed.

The deposits in the overhead equipment associated with a thermal conversion unit are analyzed for metal residue of the metal of the nonvolatile metal containing organic compound, which will most preferably be copper. Non-limiting types of overhead equipment where coke deposition is a problem include reactor overhead areas, cyclones, and the like. The cyclones are generally analyzed first because the cyclone is the first place to condense heavy liquids after leaving the thermal conversion zone.

Coke deposits may be due to a variety of causes, including feedstock entrainment or condensation of vaporized feedstock. The copper oxide residue in the reactor overhead areas identifies the source of the coke deposits. If there are low levels of copper residue in the overhead areas, then the coke deposits are due to the condensation of vapors. If the overhead areas contain high levels of copper residue, then the coke deposits are due to feed entrainment. If both mechanisms are operating, then intermediate levels of copper will be observed.

Based upon the determination of the source of coking, the process conditions or the overhead equipment can be adjusted to reduce or mitigate coking. When the coke deposits are due to condensation of vapors, an adjustment can be to superheat the vapor with coke, steam and the like at a heater temperature of about 620–630° C., or to lower the temperature of the thermal conversion process unit, e.g. the fluidized bed coking unit can be lowered to 510° C. and the short contact time coking unit can be lowered to 550° C.

When the coke deposits are due to feed entrainment, mechanical changes can be made to the feed nozzle droplet spray size and/or to the mixer to get better mixing and more effective capture of the small feed droplets.

EXAMPLE 1

A test was run to verify the ability to keep copper from volatilizing and being carried over with the volatile feed components and products in the current invention.

A vacuum resid feed was doped with 192 ppm of copper as copper naphthenate. A short path vacuum distillation was performed. Several boiling fractions of product as well as the coke resulting from pyrolsis of these fractions were analyzed for carryover of copper. The resulting material balance (Table 1) indicates essentially no copper volatility.

EXAMPLE 2

A test was run to demonstrate the source of fouling in overhead equipment.

A pilot plant coking unit capable of replicating the foulant formed in a commercial unit was used to test whether the deposits overhead of the cyclone were formed by entrainment of feed or by vapor condensation. A typical pilot plant run consisted of an 8 hour operating period at a temperature around 585° C. and pressure of 1.0 bar. The vacuum resid feed rate was maintained at 1.2 kg/hr and coke circulation rate was maintained at 20 kg/hr. The coke used in the circulation typically came from the commercial unit, which has a Sauter mean diameter of about 700 μm.

The vacuum resid feed was doped with 150 ppm of copper as copper naphthenate before the feed was sprayed onto a bed of coke particles in a twin screw coking pilot plant. After the pilot run, the cyclone deposits were analyzed for copper. The cyclone deposit contained 80 wppm of copper compared to over 1000 wppm expected if the deposit was formed by feed entrainment. The 80 wppm copper could be contributed from coke fines. The coke fines contained copper because it was derived from the feed which contained 150 wppm copper.

EXAMPLE 3

Based upon the successful demonstration that vapor condensation was responsible for foulant coke deposits in the cyclone of the small pilot plant, 50 wppm of copper as copper naphthenate was added to the vacuum resid feed before spraying the feed onto a bed of coke particles in a larger twin screw coking unit. The unit was operated under about 1.2 bar pressure. After four days of operation, three samples were taken of the overhead foulant, which showed copper levels of 18, 14, and 12 wppm for the three different samples compared to about 350 ppm Cu expected if feed entrainment is the major fouling mechanism. In addition, samples of deposits taken near the reactor outlet were analyzed for a result of 13 and 17 wppm copper. These results confirm the small pilot plant results.

EXAMPLE 4

A detailed analysis of metals was carried out on coke samples of Example 3 taken at the mixer outlet, before the cyclone. These results, summarized in Table 2, show that as the surface of the calcined starting coal tar coke is displaced by product coke there is a decrease in the chromium level present in the original coal tar coke, but absent in the feed. Nickel and vanadium levels both increase over the short time period of the run, approaching equilibrium levels after four days. The level of copper gradually increases to 345 ppm, the expected level, in the coke.

TABLE 1

SHORT PATH DISTILLATION (DISTAC) OF COPPER DOPED SHORT VAPOR CONTACT TIME THERMAL PROCESS UNIT VACUUM RESID

| Dist. Wts.[1] | Distillation Fraction | Starting Feed (PPM) | Overhead (PPM) | Microcarbon Residue Test[a] Overhead (Wt %) | Coke (PPM) | Microcarbon Residue Test[a] Coke (Wt. %) | Comments[3] |
|---|---|---|---|---|---|---|---|
| 100.0 | Cu Doped Vac. Resid Feed | | | 78.4 | | 18.9 | Theoretical: |
| | Cu | 192.0 | <0.11 | | 1030.0 | | Cu, 1015 ppm |
| | V | 79.3 | 1.84 | | 444.0 | | V, 420 ppm |
| | Ni | 50.4 | 4.77 | | 291.0 | | Ni, 267 ppm |
| 61.0 | Distac Vac. Resid, 1200° F.+ | | | 66.0 | | 26.4 | Theoretical: |
| | Cu | 306.0 | <0.40 | | 933.0 | | Cu, 1159 ppm |
| | V | 121.0 | 1.25 | | 439.0 | | V, 459 ppm |
| | Ni | 84.8 | 23.5 | | 304.0 | | |
| 24.2 | Vac. Resid. Distillate, 1100–1200° F. | | | 92.2 | | 3.6 | Theoretical: |
| | Cu | 3.75 | 0.55 | | 47.9[2] | | Cu, 104 ppm |
| | V | 56.6 | 3.71 | | 52.9[2] | | V, 1573 ppm |
| | Ni | 33.8 | 35.7 | | 27.0[2] | | |
| 14.8 | Vac. Distillate Init. - 1100° F. | | | 90.7 | | 1.7 | Not enough sample to do metals on coke. Coke should be: |
| | Cu | 0.04 | 0.32 | | N.D. | | Cu, 2.4 ppm |
| | V | 15.7 | 2.79 | | N.D. | | V, 923 ppm |
| | Ni | 11.4 | 17.8 | | N.D. | | |

[1]Calculated from distillation cuts for resid feed: Cu 188.5 ppm
V 89.8 ppm
Ni 61.6 ppm

[2]Coke sample too small for accurate metals analysis

[3]Calculated from coke yield and metals analysis, using approximation that all metals go to coke; not done for Ni for runs with high Ni in liquids.

[4]Microcarbon Residue Test ASTM No. 4530-93.

TABLE 2

METALS (ICPES)* ANALYSIS OF DOPED SHORT VAPOR CONTACT TIME THERMAL PROCESS UNIT REACTOR OUTLET SAMPLES IN PPM (AVERAGE TEMPERATURE 592° C. [1098° F.])

| Sample Description | Co | Cr | Cu | Ni | V |
|---|---|---|---|---|---|
| VGO Reactor Outlet (R.O.), 590° C. | — | 27.6 | — | 23.9 | 8.39 |
| Vac. Resid R.O., 1 hr. at ½ feed rate | — | — | 103 | 39.6 | 48.9 |
| Vac. Resid R.O., 1 hr. at ½ feed rate, Filter Sample, No $N_2$ under box stored in. | — | 22.4 | 71.7 | 47.2 | 35.1 |
| Vac. Resid R.O., 20 hrs. | — | 10.7 | 191 | 153 | 201 |
| Vac. Resid, R.O., 25.5 hrs. | — | — | 158 | 136 | 181 |
| Vac. Resid, R.O., 593° C., 87.5 hrs. | 5.38 | — | 319 | 293 | 383 |
| Vac. Resid, R.O., 588° C., 90 hrs. | 6.02 | — | 345 | 322 | 422 |

*Inductively Coupled Plasma Emission Spectroscopy

The invention claimed is:

1. A method for determining the source of coke deposits in overhead equipment in a heavy hydrocarbon thermal conversion process unit for converting heavy hydrocarbon feedstock to lower boiling products, comprising the steps of:

(a) introducing an effective amount of at least one nonvolatile metal-containing organic compound into a heavy hydrocarbon feedstock, which said nonvolatile metal-containing organic compound is completely soluble in said heavy hydrocarbon feedstock;

(b) converting at least a fraction of said heavy hydrocarbon feedstock containing said nonvolatile metal-containing organic compound in a thermal conversion zone of said process unit to lower boiling products and resulting in a vapor product stream;

(c) passing said vapor product stream through at least one piece of overhead equipment associated with said thermal conversion process unit wherein coke deposits form in at least one piece of said overhead equipment;

(d) analyzing said coke deposits for the metal of said nonvolatile metal-containing compound; and (e) determining that the source of coke deposits in said at least one piece of overhead equipment results from: (i) condensation of said vapor product stream or (ii) entrainment of feed droplets in said vapor product stream.

2. The method of claim 1 wherein the thermal conversion process unit is a fluidized bed coking unit.

3. The method of claim 2 wherein the nonvolatile metal-containing organic compound is selected from metalloporphyrins, metal anetylocetonates, and metal naphthenates.

4. The method of claim 3 wherein the nonvolatile metal-containing organic compound is copper naphthenate.

5. The method of claim 1 where at least one piece of overhead equipment is a cyclone.

6. The method of claim 5 wherein the nonvolatile metal-containing organic compound is copper naphthenate.

7. The method of claim 1 wherein the heavy hydrocarbon feedstock is selected from the group consisting of vacuum resids, atmospheric resids, heavy and reduced petroleum crude oil, pitch, asphalt, bitumen, coal slurries, coal liquefaction bottoms and the heaviest fractions of tar sand oil and shale oil.

8. The method of claim 6 wherein the heavy hydrocarbon feedstock is selected from the group consisting of vacuum resids, atmospheric resids, heavy and reduced petroleum crude oil, pitch, asphalt, bitumen, coal slurries, coal liquefaction bottoms, and the heaviest fractions of tar sand oil and shale oil.

9. A method for determining the source of coke deposits in overhead equipment in a fluidized bed coking unit for converting heavy hydrocarbon feedstock to lower boiling products, comprising the steps of:

(a) introducing from about 10 to 1000 wppm of copper naphthenate into a heavy hydrocarbon feedstock;

(b) converting at least a fraction of said heavy hydrocarbon feedstock containing said copper naphthenate in a thermal conversion zone of said coking unit to lower boiling products and resulting in a vapor product stream;

(c) passing said vapor product stream through at least one piece of overhead equipment associated with said coking unit wherein coke deposits form in at least one piece of said overhead equipment;

(d) analyzing said coke deposits for the copper; and (e) determining tat the source of coke deposits in said at least one piece of overhead equipment results from: (i) condensation of said vapor product or (ii) entrainment of feed droplets in said vapor product stream.

10. The method of claim 9 where at least one piece of overhead equipment is a cyclone.

11. The method of claim 9 wherein the heavy hydrocarbon feedstock is selected from the group consisting of vacuum resids, atmospheric resids, heavy and reduced petroleum crude oil, pitch, asphalt, bitumen, coal slurries, coal liquefaction bottoms and the heaviest fractions of tar sand oil and shale oil.

12. A method for thermally converting a heavy hydrocarbon feedstock to lower boiling products in a thermal conversion process unit, comprising the steps of:

(a) introducing from about 10 to 1000 wppm of at least one nonvolatile metal-containing organic compound into a heavy hydrocarbon feedstock, which said nonvolatile metal-containing organic compound is substantially soluble in said heavy hydrocarbon feedstock;

(b) injecting said hydrocarbon feedstock containing said nonvolatile metal-containing organic compound through a feed nozzle to said thermal conversion process unit;

(c) converting at least a fraction of said heavy hydrocarbon feedstock containing said at nonvolatile metal-containing organic compound in a thermal conversion zone of said thermal conversion process unit to lower boiling products and resulting in a vapor product stream;

(d) passing said vapor product stream through at least one piece of overhead equipment associated with said thermal conversion process unit wherein coke deposits form in at least one piece of said overhead equipment;

(e) analyzing said coke deposits for the metal of said nonvolatile metal-containing compound;

(f) determining that the source of coke deposits in said at least one piece of overhead equipment results from: (i) condensation of said vapor product or (ii) entrainment of reed droplets in said vapor product stream;

(g) lowering the temperature of said thermal conversion process unit or increasing the temperature of said vapor product stream by an amount effective to reduce coke formation when the coke deposits are due to condensation of vapors; or (h) adjusting the feed nozzles or mixers by an amount effective to reduce coke formation when the coke deposits result from feed entrainment.

13. The method of claim 12 wherein the thermal conversion process unit is a fluidized bed coking unit.

14. The method of claim 12 wherein the nonvolatile metal-containing organic compound is selected from metalloporphyrins, metal acetylocetonates, and metal naphthenates.

15. The method of claim 14 wherein the nonvolatile metal-containing organic compound is copper naphthenate.

16. The method of claim 12 where at least one piece of overhead equipment is a cyclone.

17. The method of claim 12 wherein the heavy hydrocarbon feedstock is selected from the group consisting of vacuum resids, atmospheric resids, heavy and reduced petroleum crude oil, pitch, asphalt, bitumen, coal slurries, coal liquefaction bottoms and the heaviest fractions of tar sand oil and shale oil.

18. A method for thermally converting a heavy hydrocarbon feedstock to lower boiling products in a thermal conversion process unit, comprising the steps of:

(a) introducing from about 10 to 1000 wppm of copper naphthenate into a heavy hydrocarbon feedstock wherein said copper naphthenate is substantially soluble;

(b) injecting said hydrocarbon feedstock containing said copper naphthenate through a feed nozzle to said thermal conversion process unit;

(c) converting at least a fraction of said heavy hydrocarbon feedstock containing said copper naphthenate in a thermal conversion zone of said thermal conversion process unit to lower boiling products and resulting in a vapor product stream;

(d) passing said vapor product stream through at least one piece of overhead equipment associated with said coking unit wherein coke deposits form in at least one piece of said overhead equipment;

(e) analyzing said coke deposits for the copper; determining that the source of coke deposits in said at least one piece of overhead equipment results from: (i) condensation of said vapor product or (ii) entrainment of feed droplets in said vapor product stream;

(f) lowering the temperature of said thermal conversion process unit or increasing the temperature of said vapor product stream by an amount effective to reduce coke formation when the coke deposits are due to condensation of vapors; or (g) adjusting the feed nozzles or mixers by an amount effective to reduce cake formation when the coke deposits result from feed entrainment.

19. The method of claim 18 wherein the thermal conversion process unit is a fluidized bed coking unit.

20. The method of claim 18 where at least one piece of overhead equipment is a cyclone.

21. The method of claim 18 wherein the heavy hydrocarbon feedstock is selected from the group consisting of vacuum resids, atmospheric resids, heavy and reduced petroleum crude oil, pitch, asphalt, bitumen, coal slurries, coal liquefaction bottoms and the heaviest fractions of tar sand oil and shale oil.

* * * * *